US005398534A

United States Patent [19]

Huet

[11] Patent Number: 5,398,534

[45] Date of Patent: Mar. 21, 1995

[54] STRUCTURE FOR SUPPORTING FORMING TOOLS IN A MACHINE FOR FORMING SHEET METAL BY STRETCHING

[75] Inventor: Jean-Paul Huet, Nantes, France

[73] Assignee: ACB, Paris, France

[21] Appl. No.: 246,480

[22] Filed: May 19, 1994

Related U.S. Application Data

[63] Continuation of Ser. No. 47,364, Apr. 19, 1993, abandoned, which is a continuation of Ser. No. 817,638, Jan. 7, 1992, abandoned.

[30] Foreign Application Priority Data

Jan. 8, 1991 [FR] France ..... 91 00158

[51] Int. Cl.[6] ..... B21D 25/02

[52] U.S. Cl. ..... 72/295; 72/302

[58] Field of Search ..... 72/295–297, 72/302, 301, 413; 248/670, 676

[56] References Cited

U.S. PATENT DOCUMENTS

| | | | |
|---|---|---|---|
| 48,538 | 7/1865 | Easay | 72/413 |
| 1,741,840 | 12/1929 | Harmon | 72/295 |
| 1,830,647 | 11/1931 | Engel | 72/413 |
| 2,334,520 | 11/1943 | Walters | 72/413 |
| 2,434,379 | 1/1948 | Wiesner | 72/302 |
| 3,426,569 | 2/1969 | Brauer | 72/295 |

FOREIGN PATENT DOCUMENTS

| | | | |
|---|---|---|---|
| 70330 | 3/1990 | Japan | 72/297 |
| 1242393 | 8/1971 | United Kingdom | 72/413 |
| 2227196 | 7/1990 | United Kingdom | 72/413 |

*Primary Examiner*—Daniel C. Crane
*Attorney, Agent, or Firm*—Sughrue, Mion, Zinn, Macpeak & Seas

[57] ABSTRACT

A structure for supporting forming tools in a machine for forming metal sheet by stretching, the structure comprising n juxtaposed table segments mounted in a stand of the machine, with at least n−1 of said table segments being individually fitted with means enabling said segment to be placed either in a high, working position, or else in a low, rest position.

7 Claims, 7 Drawing Sheets

STRUCTURE FOR SUPPORTING FORMING TOOLS IN A MACHINE FOR FORMING SHEET METAL BY STRETCHING

This is a continuation of application Ser. No. 08/047,364, filed on Apr. 19, 1993, now abandoned, which is a continuation of application Ser. No. 07/817,638, filed Jan. 7, 1992, now abandoned.

The present invention relates to a structure for supporting forming tools in a machine for forming sheet metal by stretching.

BACKGROUND OF THE INVENTION

The invention relates particularly to machines capable of stretching in the longitudinal direction of the forming tool, i.e. in the direction perpendicular to its greatest curvature, requiring jaws that are so hinged as to enable them to pivot in compliance with the greatest curvature of the forming tool. The term "longitudinal stretching" is used below for referring to stretching as defined above relative to the positioning direction of the forming tool on the machine, and independently of the fact that the sheet metal may be stretched lengthwise or breadthwise. Conversely, the term "transverse stretching" is used when the sheet is stretched in the direction which corresponds to the greatest curvature of the forming tool.

Under such circumstances, the jaws are generally disposed rectilinearly.

In longitudinal stretching, there is a very wide variety of forming tools and the length thereof may be as much as 12 meters or as little as 50 cm, for example. In machines designed specially for transverse stretching, and having rectilinear clamps, the maximum width of the forming tool does not in general exceed 4 meters and a single table or work surface suffices for installing the tools.

However, for longitudinal stretching, the wide range of dimensions and the lightweight structure of the tools require tool carriers to be used that are of different dimensions.

However, the problem may also arise with machines for transverse stretching.

At present, two techniques are in use:

1/the first technique uses rigid modular tool carriers of dimensions such that each covers a range of tool formats. This solution makes it possible to support the tools over their entire length, but it requires the machine to be taken out of service for a long time when changing the tool carriers. It also requires very expensive and bulky handling and storage of said tool carriers, sometimes called "props";

2/the second known technique makes use of a plurality of tables: either two tables or three.

When using two tables, they are adjustable in spacing.

When using three tables, the middle table is fixed and the two side tables are adjustable in spacing relative to the middle table. This technique does not enable the forming tools to be fully supported and it therefore requires tools that are of reinforced structure, thereby increasing the cost and the weight of the tools. In addition, in this technique, there are deep gaps between the moving tables and these gaps must be covered by moving floors for essential safety reasons. The floors are put into place by hand.

An object of the present invention is to mitigate these drawbacks and to propose a structure that makes it possible to use forming tools that are lightweight in structure, that are fully supported, and that provide complete safety for personnel without requiring planks to be handled to cover any gaps. The principle of the invention is equally applicable to transverse stretching machines and to longitudinal stretching machines, and indeed the same machine may perform both ways if its clamps are capable of pivoting.

SUMMARY OF THE INVENTION

The present invention thus provides a support structure for supporting forming tools in a machine for forming metal sheet by stretching, wherein the support structure comprises n juxtaposed table segments mounted in a stand of the machine, with at least n-1 of said table segments being individually fitted with means for placing said segment either in a high, working position, or else in a low, rest position.

In a preferred embodiment, the central table segment is permanently disposed in a high, working position.

According to another feature of the invention, each segment is fitted at each of its two longitudinal ends with a telescopic extender.

This feature makes it possible to support forming tools that are long in a direction perpendicular to the distance between two stretching clamps of the support.

As further explained below, such extenders also make it possible to fix and to tension transverse straps or to clamp a counter-form against the forming tool.

BRIEF DESCRIPTION OF THE DRAWINGS

An embodiment of the invention is described by way of example with reference to the accompanying drawings, in which.

DETAILED DESCRIPTION

Figure 1:
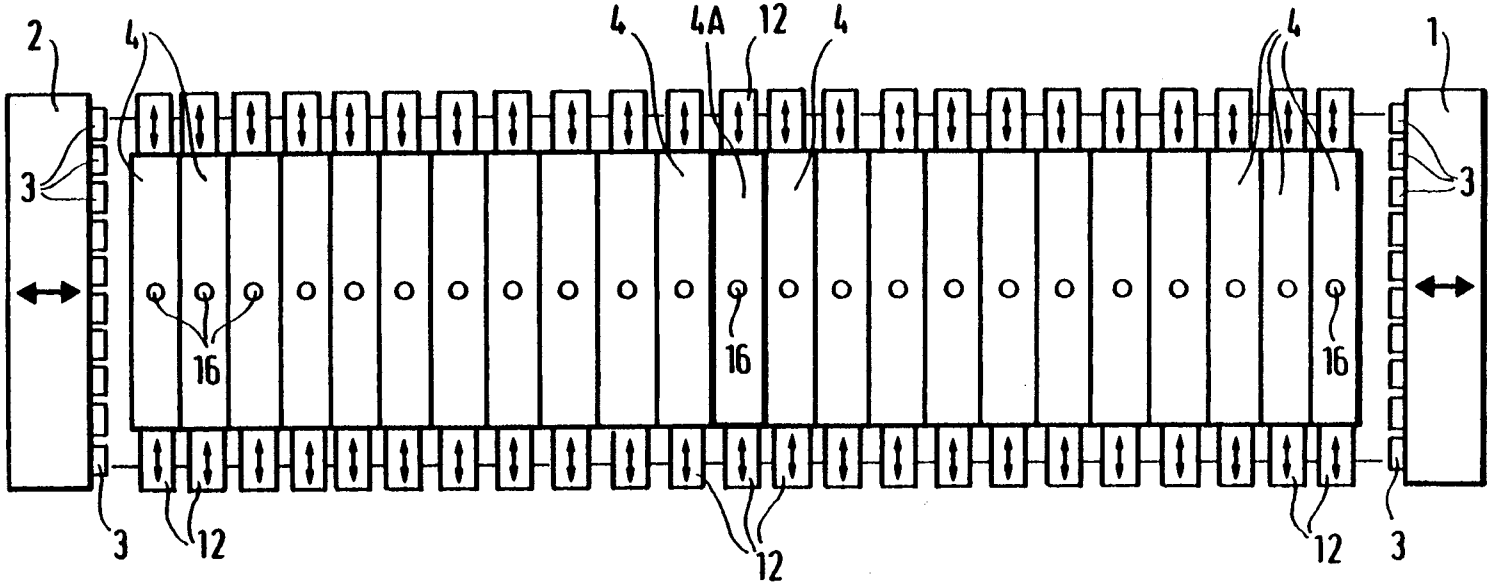
FIG. 1 is a diagrammatic plan view showing the support structure of the invention.

With reference to FIG. 1, there can be seen a support structure of the invention for supporting forming tools in a machine for forming metal sheet by stretching.

In this figure, there can be seen the clamps 1 and 2 of the machine. For example they may be clamps having hinged jaws 3.

The invention does not relate to the clamps.

The support structure 100 of the invention is a structure of variable geometry and it comprises n juxtaposed table segments 4. Twenty-three segments are shown in FIG. 1, but the number could be different. By way of example, each segment may be 45 cm wide and 2.80 meters (m) long.

Figure 2:
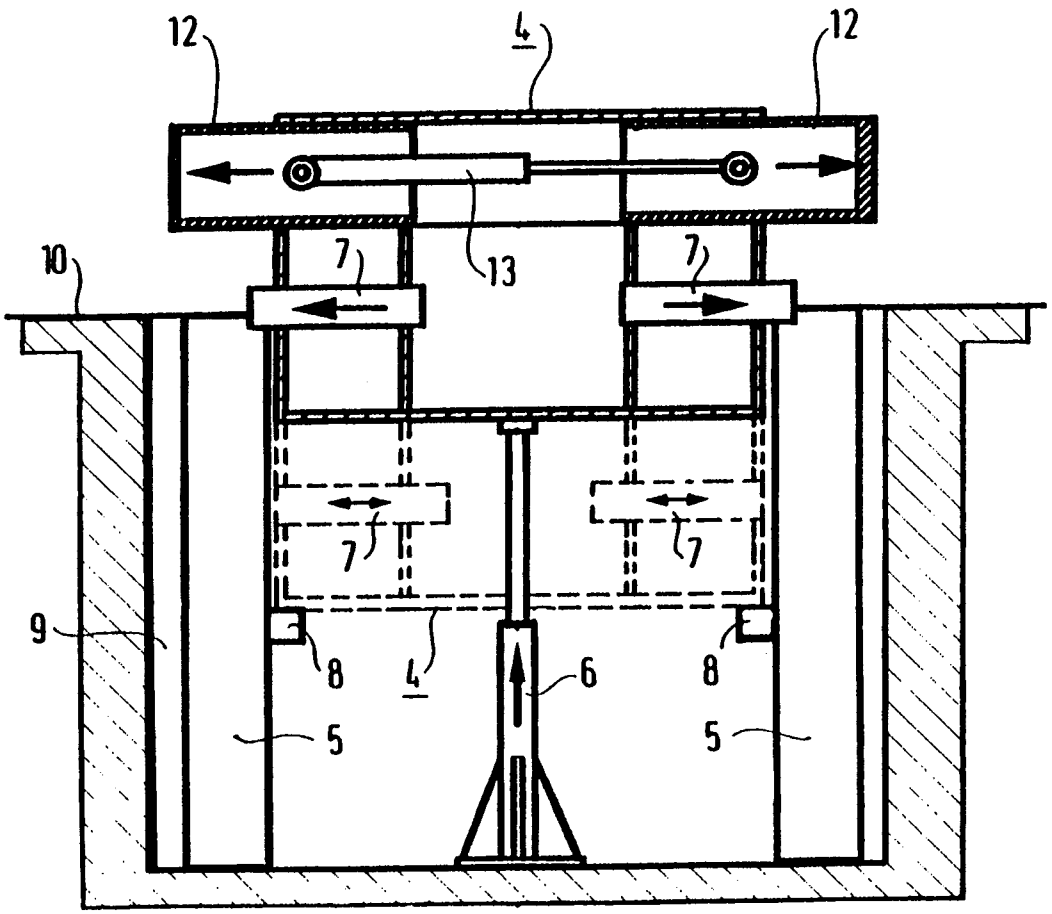
FIG. 2 is a diagrammatic view parallel to the clamps showing one of the table segments of the support structure of the invention in its high or "working" position.

As shown in FIG. 2, the table segments 4 are mounted in a stand 5. Each table segment, or preferably each of the table segments except for one, is provided with means enabling it to be placed either in a high or working position as is the case for segment 4 in FIG. 2, or else in a low or rest position as shown in dashed lines in the same FIG. 2. The means used may be a hydraulic actuator 6, for example.

As mentioned above, it is preferable for all of the segments except for one to be so equipped since whatever the size of the forming tool, it must be supported on at least one segment. Thus, the middle segment referenced 4A, FIG. 1, is preferably a segment that is fixed in the high, working position.

When in the high position, the actuators are held by latches 7 bearing against the stand 5. When in the low position each table segment rests on blocks 8.

Figure 3:
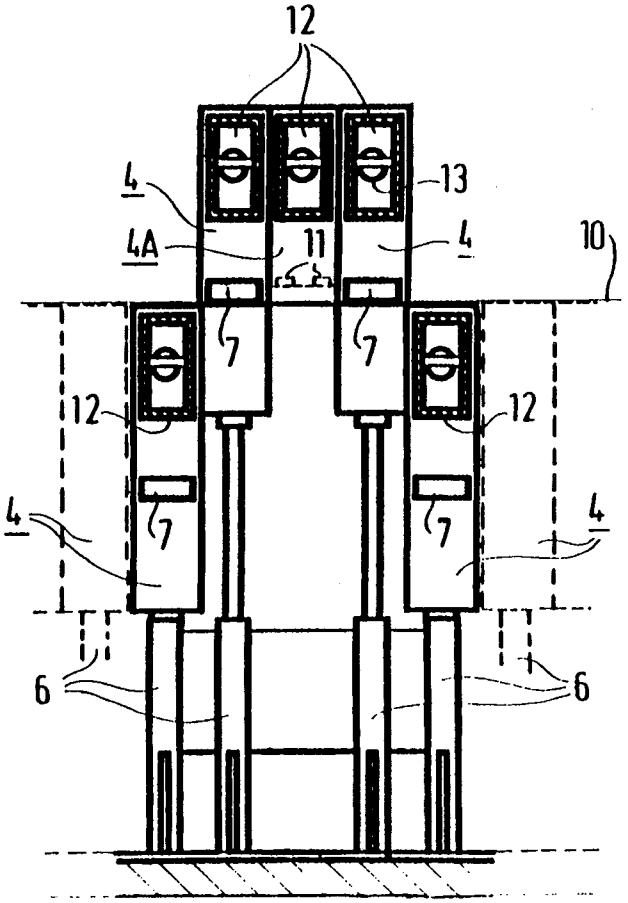
FIG. 3 is a fragmentary diagrammatic view of the left of FIG. 2 showing three table segments in the high position and the other table segments in the low or "rest" position.

The stand 5 is installed in a trench 9, FIG.2, and, when in the low, rest position the segments are at the same level as the ground 10 as can be seen in FIG. 3 which shows two segments 4 in the high, working position, and also the fixed middle segment 4A which is bolted at its bottom end to the stand 5 by means of bolts 11, whereas all of the other segments 4 are shown in the low, rest position.

Figure 9:
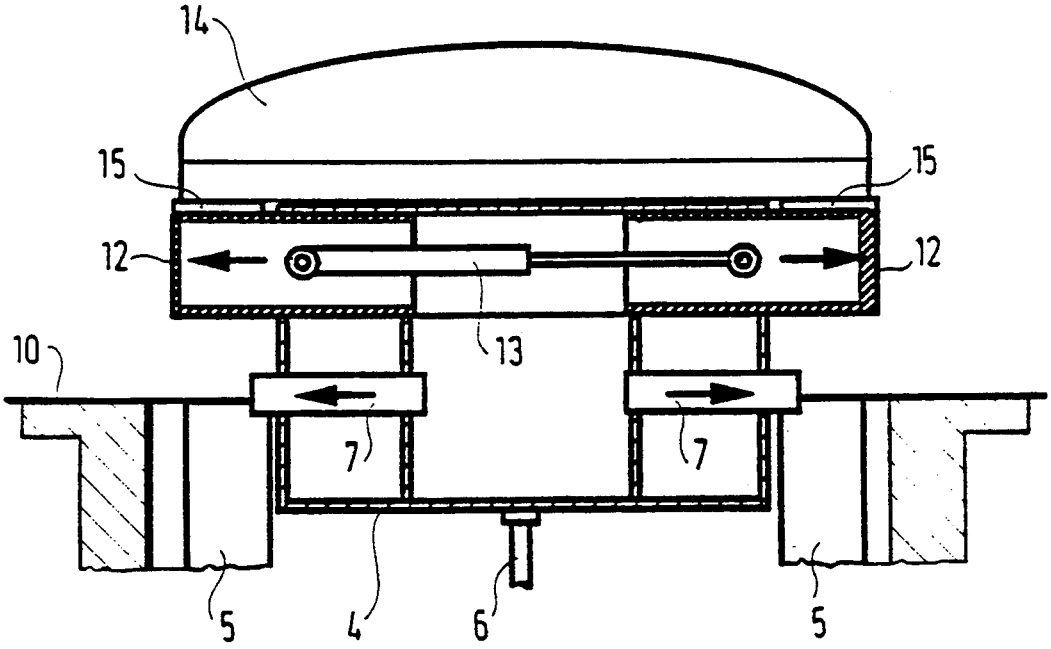

Each of the table segments 4, including the fixed middle segment 4A, includes a telescopic extender 12 at each of its ends. These extenders are driven by hydraulic actuators 13. These extenders make it possible to support very wide forming tools, such as the tool 14 shown in FIG. 9. To this end, blocks 15 serve to make up the top level of each extender relative to the table segment 4.

Figure 4:
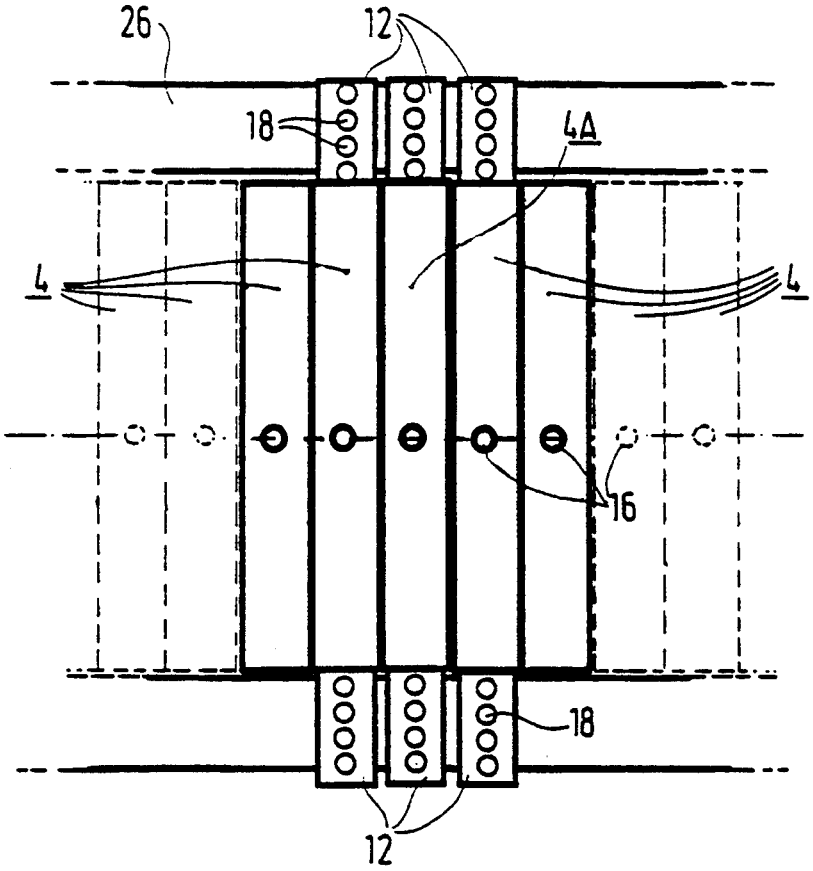
FIG. 4 is a plan view of FIG. 3.

FIG. 4 is a fragmentary plan view showing the fixed middle segment 4A together with the two segments adjacent thereto having their extenders 12 in the extended position.

For positioning forming tools, the table segments 4 and 4A have respective holes 16 for receiving the positioning studs of the forming tools.

Figure 7:
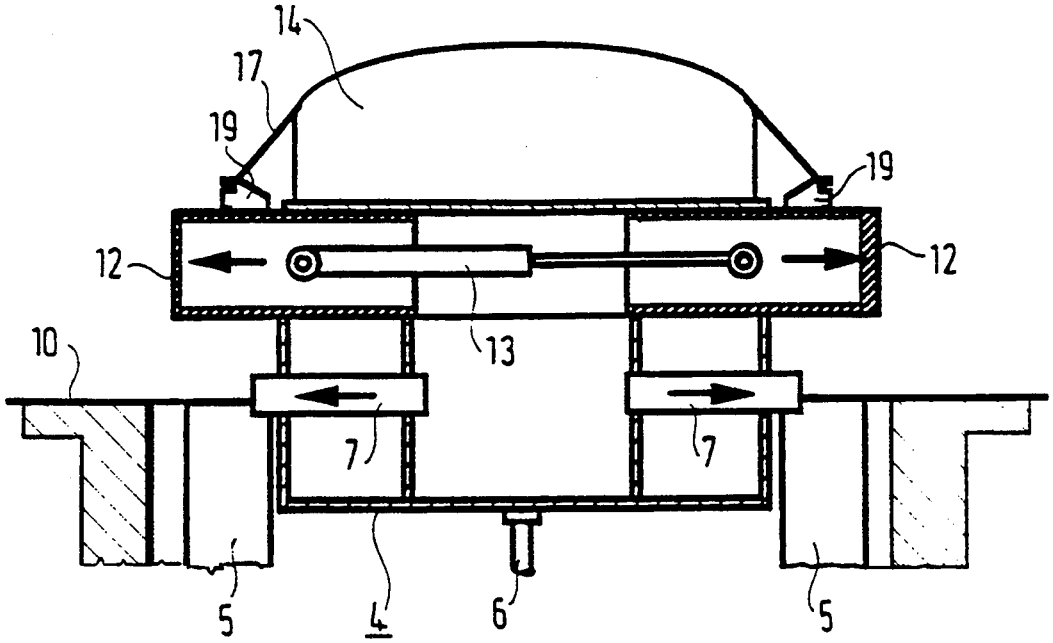
FIG.7 to 10 are various diagrammatic transverse views of a preferred embodiment showing various different ways in which the extenders can be used.
Figure 8:
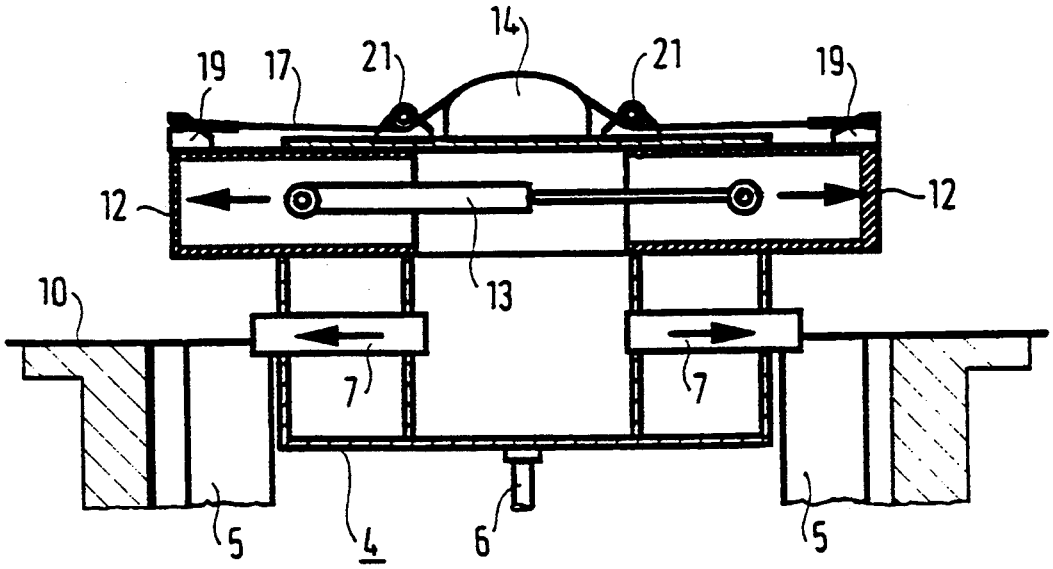

As shown in FIGS. 7 and 8, the extenders 12 may also be used for fixing and tensioning transverse straps 17 for use during longitudinal stretching with jaws in a curved position.

Figure 5:
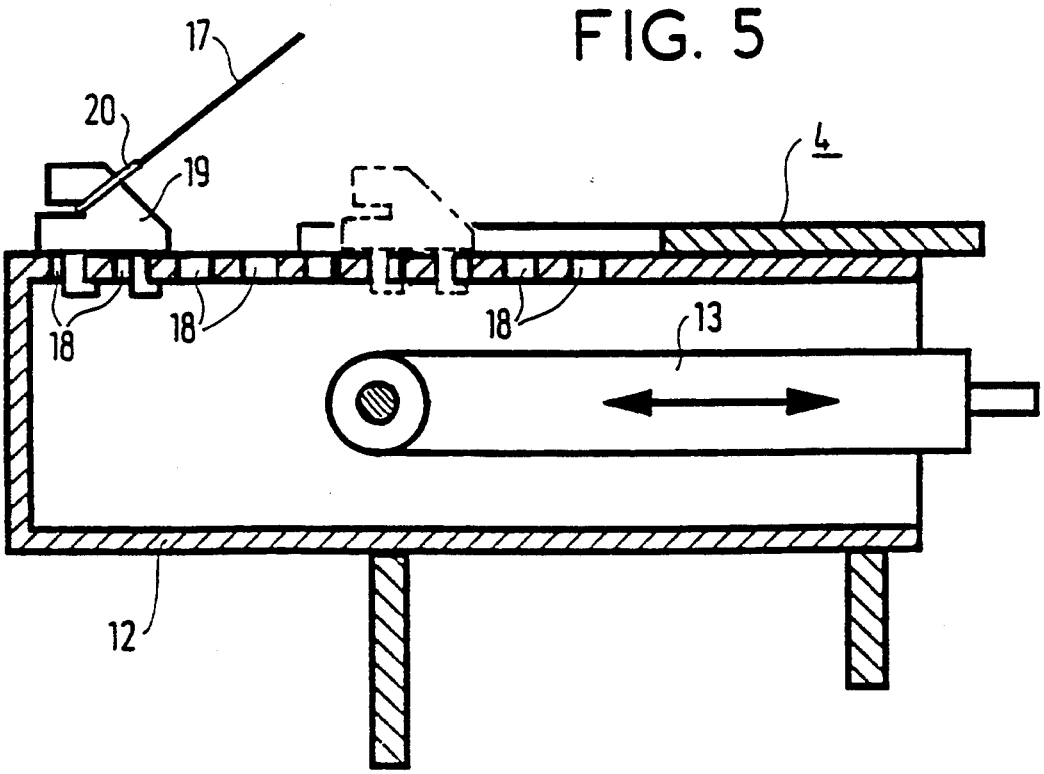
FIG. 5 is a diagrammatic fragmentary view of a table segment showing how an extender may be used as an anchor point for a transverse strap.

To this end, the extenders 12 such as that shown in Figure 5 have holes 18 for receiving tensioning hooks 19 to which the straps 17 may be connected by means of rings 20. Because of the large number of holes 18, the positioning of the hooks 19 is adjustable. The straps 17 are tensioned by the extender actuators 13.

FIGS. 7 and 8 thus show two ways in which the extenders can be used for fixing straps 17.

In FIG. 8, the forming tool 14 is narrow and auxiliary deflecting rollers 21 are used.

Figure 10:
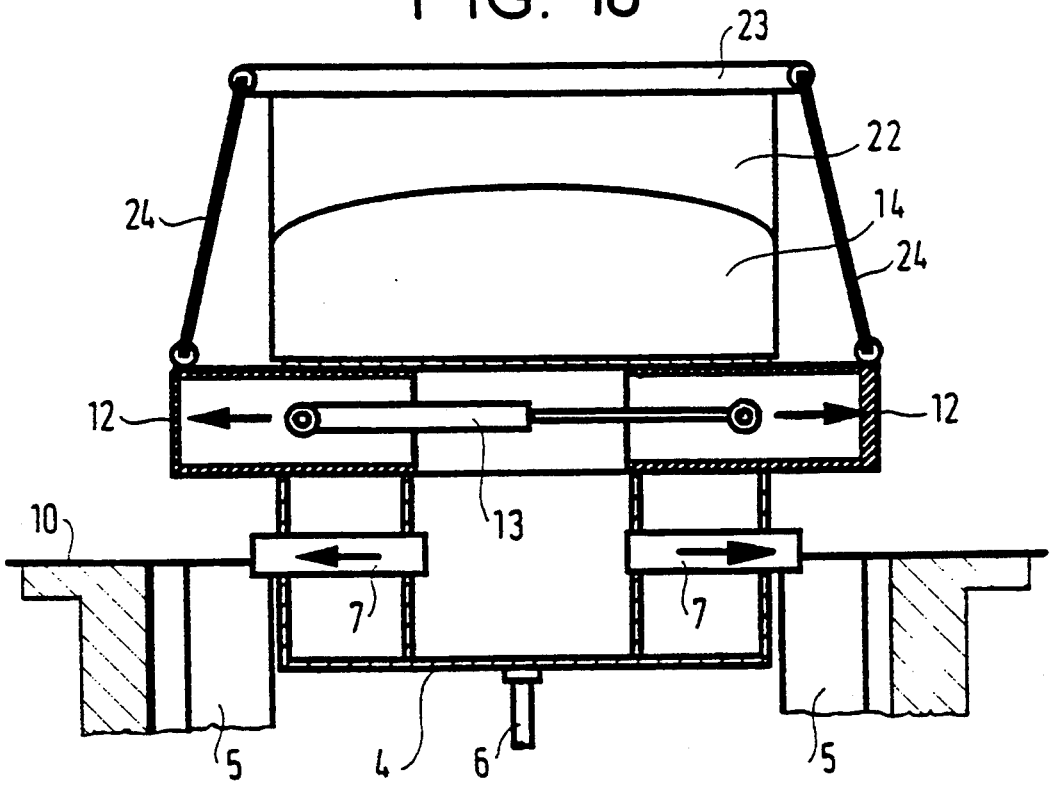

In FIG. 10, the extenders are used to clamp a counterform 22 against the forming tool 14. To this end, transverse beams 23 and tie bars 24 are used. Each tie bar 24 is hinged to one of the ends of a beam 23 and at its other end it is hinged to an extender 12. The clamping force is likewise provided by the actuators 13 of the telescopic extenders 12.

The extenders can thus be used either to support forming tools of large transverse size, or else to fix and tension straps while performing longitudinal stretching, or indeed to clamp counter-forms on the forming tool.

Figure 6:
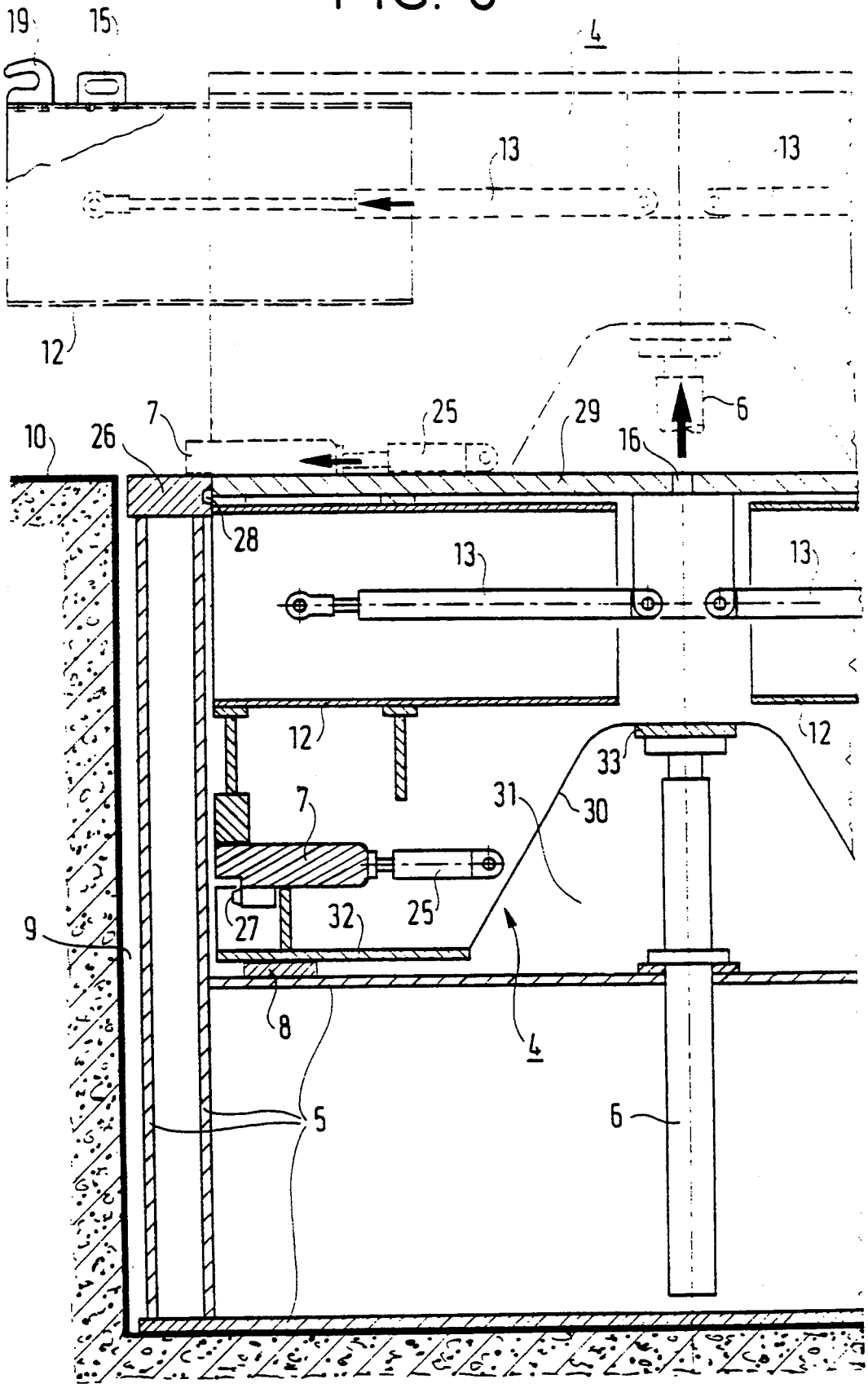
FIG. 6 is a half sectional view corresponding to FIG. 2 showing the lower or rest position together with an upper, working position shown in dashed lines.

FIG. 6 is similar to FIG. 2, but shows one possible practical embodiment of a table segment 4.

In this view, the table segment 4 is shown in heavy solid lines in its low, rest position, and in fine dashed lines in its high, working position. The same references correspond to equivalent items in the other figures.

As can be seen, the latches 7 are actuated by actuators 25. In the high position, the latches bear against the longitudinal beams 26 of the stand 5 and the latches 7 have respective studs 27 that penetrate into blind holes 28 in the longitudinal beams 26.

In the example shown, the table segment 4 is constituted by a box section having a top floor 29, two vertical walls 30 each having a notch 31 for forming an inspection passage along all of the segments, and a bottom wall 32 that is in two portions that are separated by the notch 31. The box section also includes transverse reinforcing members. The rod of the segment driving actuator 6 bears against a transverse reinforcing member 33.

As can be seen in this figure, each extender 12 of a segment 4 is actuated by an actuator 13.

In the high, working position shown in fine, dashed lines, the extender 12 is shown in its extended position and it is shown carrying a level make-up block 15 together with a hook 19 for connection to a transverse strap.

FIGS. 11 to 15 show various possible ways in which the support structure can be used depending on the size of the forming tool in use.

Figure 11:
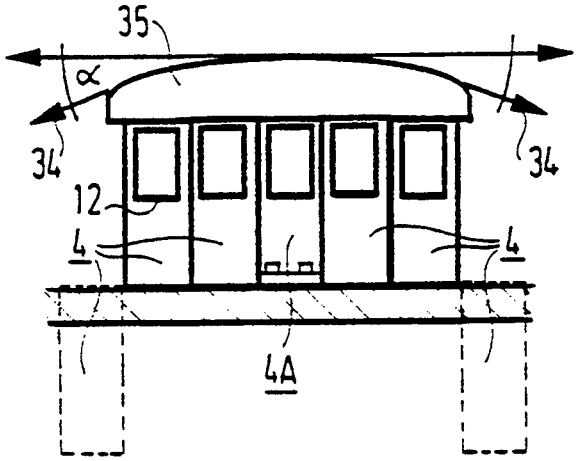
FIGS. 11 to 15 are various diagrammatic views in the longitudinal direction (from one clamp to the other) showing various ways in which the table segments can be used depending on the forming tools that are in use.

In FIG. 11 the tool forming 35 is very long, for use in longitudinal stretching. To simplify the drawing, only five segments 4 are shown in the high, working position, but naturally many more of them could be in the high position, e.g. all of them. There may be a large number of segments, e.g. twenty-five or twenty-seven.

In this figure, arrows 34 show the direction in which the stretching clamps 1, 2 apply traction. This example shows longitudinal stretching, and the forming tool 14 is highly curved in the direction perpendicular to the figure, with the jaws of the clamp being at an angle.

In this example where the forming tool 14 is supported by five segments, and assuming that each clamp 1, 2 exerts a force F in the direction of the arrows 34, the total vertical force supported by the segments 4, 4A is: $2F\sin\alpha$.

Figure 12:
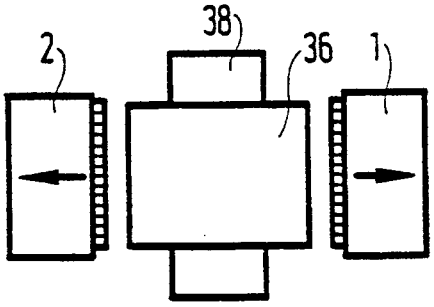
Figure 13:
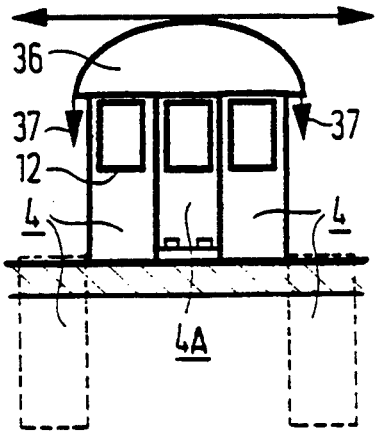

FIG. 12 shows an example in which there can be seen a forming tool 36 (also shown in FIG. 13) which is placed in a direction that corresponds to transverse stretching in which the jaws are used in a rectilinear position and in which traction may be exerted vertically. As shown in FIG. 13, the total force exerted on the three segments 4, 4A in the working position is 2 F assuming that each clamp 1, 2 exerts a force F in the direction of arrows 37.

In FIG. 12, there can also be seen a forming tool 38 which is long in shape and which is normally used during longitudinal stretching, i.e. in a position at 90° to the position in which it is shown, but which may also be disposed in the direction shown for stretching narrow strips that are used, for example, to reinforce a metal sheet that has previously been stretched and formed on the forming tool 38 while placed in the longitudinal position.

Figure 14:
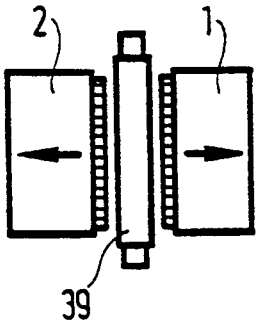
Figure 15:
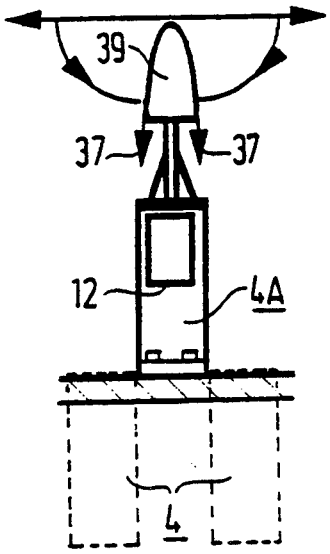

FIGS. 14 and 15 show an example of transverse stretching on a forming tool 39 placed on the single fixed middle segment 4A.

The force exerted on this segment 4A is equal to 2F if, as in the preceding cases, the force exerted by each clamp 1, 2 in the direction of arrows 37 is F.

These three examples show that the middle segment 4A which may be used on its own must be dimensioned so as to be able to withstand a total force of 2F all on its own. The various segments around it, e.g. three on each side, may be dimensioned so as to be less strong, but they nevertheless need to be quite strong. The other segments down to the ends of the structure may be dimensioned so as to be even less strong since firstly the 2F forces are distributed over a larger number of segments, and secondly because with more than about seven segments, longitudinal stretching is no longer performed and thus the vertical force exerted on the segments is reduced by the factor sinα (FIG. 11), since in longitudinal stretching the force 34 is never vertical.

Thus, as can be seen, the support structure of the invention is capable of adapting to all possible dimensions of forming tool. In addition, this structure provides a high degree of safety since there are no longer any gaps to be covered, with unused segments remaining at ground level. Finally, the extenders 12 enable tools of large dimensions to be placed perpendicularly to the direction between the two clamps 1, 2, or else to be used for clamping a counter-form on the forming tool, or indeed, in longitudinal stretching, to fix and to tension transverse straps.

I claim:

1. A support table defining a plane surface for supporting a forming tool (14, 35, 36, 38, 39), in a machine for forming a metal sheet by stretching said metal sheet about said forming tool, said support table comprising a stand (5), a plurality of n table segments (4, 4A) each including a flat, upper working surface, mounted side by side in said stand (5), at least n−1 of said table segments (4) comprising means (6) for selectively placing said n−1 table segments in one of a high working position and a low rest position relative to said stand so that said flat, upper working surfaces constitute a support table plane surface in the raised position having a length adapted to a length of said forming tool (14, 35, 36, 38, 39), said support table plane surface always defining a substantially flat surface in a common plane regardless of the number of table segments which are placed in the high working position, wherein said support table has a length, each of said n table segments is fitted at opposite ends, transverse to the length of said support table with a telescopic extender which may be extended or withdrawn from said table segment to increase a width of the raised table segments to match a width of the forming tool.

2. A support table according to claim 1, wherein said telescopic extenders have fixed thereto respective opposite ends of transverse straps and means for extending and withdrawing said telescopic extenders for tensioning of said transverse straps during stretching said metal sheet.

3. A support table defining a plane surface for supporting a forming tool (14, 35, 36, 38, 39), in a machine for forming a metal sheet by stretching said metal sheet about said forming tool, said support table comprising a stand (5), a plurality of n table segments (4, 4A) each including a flat, upper working surface, mounted side by side in said stand (5), at least n−1 of said table segments (4) comprising means (6) for selectively placing said n−1 table segments in one of a high working position and a low rest position relative to said stand so that said flat, upper working surfaces constitute a support table plane surface in the raised position having a length adapted to a length of said forming tool (14, 35, 36, 38, 39), said support table plane surface always defining a substantially flat surface in a common plane regardless of the number of table segments which are placed in the high working position, wherein said stand (5) is disposed in a cavity (9) in the ground (10), and wherein said means for placing said at least n−1 table segments (4) in one of a high working position and in a low rest position comprises means for placing said flat, upper working surface of each of said n−1 table segments in said low rest position at a surface level of the ground (10).

4. A support table in combination with a forming tool and a machine for forming a metal sheet by stretching the metal sheet about said forming tool, said support table defining a plane surface for supporting said forming tool, said forming tool resting on said plane surface, said support table comprising:

a stand (5), a plurality of n table segments (4, 4A), each including a flat, upper working surface, mounted side by side in said stand (5), at least n−1 of said table segments (4) comprising means (6) for selectively placing said n−1 table segments in one of a raised working position and a low rest position relative to said stand so that said flat, upper working surfaces constitute a support table plane surface in the raised working position having a length corresponding to a length of said forming tool, said support table plane surface always defining a substantially flat surface in a common plane regardless of the number of table segments which are placed in the raised working position.

5. A support combination according to claim 4 wherein a central table segment is permanently fixed in said raised, working position centered longitudinally between said n−1 table segments.

6. A support table defining a plane surface for supporting a forming tool (14, 35, 36, 38, 39), in a machine for forming a metal sheet by stretching said metal sheet about said forming tool, said support table comprising a stand (5), a plurality of n table segments (4, 4A), mounted side by side in said stand (5), at least n−1 of said table segments (4) comprising means (6) for selectively placing said n−1 table segments in one of a high working position and a low rest position relative to said stand so as to constitute a support table plane surface in the raised position having a length adapted to a length of said forming tool (14, 35, 36, 38, 39), wherein said support table has a length, each of said n table segments is fitted at opposite ends, transverse to the length of said support table with a telescopic extender which may be extended or withdrawn from said table segment to increase a width of the raised table segments to match a width of the forming tool.

7. A support table defining a plane surface for supporting a forming tool (14, 35, 36, 38, 39), in a machine for forming a metal sheet by stretching said metal sheet about said forming tool, said support table comprising a stand (5), a plurality of n table segments (4, 4A), mounted side by side in said stand (5), at least n−1 of said table segments (4) comprising means (6) for selectively placing said n−1 table segments in one of a high working position and a low rest position relative to said stand so as to constitute a support table plane surface in the raised position having a length adapted to a length of said forming tool (14, 35, 36, 38, 39), wherein said stand (5) is disposed in a cavity (9) in the ground (10), and wherein said means for placing said at least n−1 table segments (4) in one of a high working position and in a low rest position comprises means for placing a flat, upper working surface of each of said n−1 table segments in said low rest position at a surface level of the ground (10).

* * * * *